United States Patent [19]

Ferguson

[11] Patent Number: 5,029,542

[45] Date of Patent: Jul. 9, 1991

[54] AUTOMATIC TUCK FORMING APPARATUS HAVING IMPROVED CLAMP MEANS

[75] Inventor: Vivian Ferguson, Richmond, Va.

[73] Assignee: Automated Machinery Systems, Inc., Richmond, Va.

[21] Appl. No.: 381,822

[22] Filed: Jul. 19, 1989

[51] Int. Cl.[5] ..... D05B 35/08; D05B 21/00

[52] U.S. Cl. ..... 112/134; 112/121.15; 112/146

[58] Field of Search ..... 112/2, 121.12, 121.15, 112/132, 133, 134, 144, 145, 146, 147, 148, 303, 311; 23/28, 34

[56] References Cited

U.S. PATENT DOCUMENTS

| | | | |
|---|---|---|---|
| 645,321 | 3/1900 | Laubscher | 112/146 |
| 1,128,619 | 2/1915 | Morgan et al. | 112/146 X |
| 3,345,964 | 10/1967 | Palmer | 112/121.15 X |
| 3,661,103 | 5/1972 | Firestein et al. | 112/134 |
| 3,805,718 | 4/1974 | Levinstein | 112/134 |
| 4,281,606 | 8/1981 | Beisler | 112/121.15 |
| 4,282,820 | 8/1981 | Fenzl | 112/121.15 |

*Primary Examiner*—Werner H. Schroeder
*Assistant Examiner*—Paul C. Lewis
*Attorney, Agent, or Firm*—Staas & Halsey

[57] ABSTRACT

An automatic tuck forming apparatus includes a mechanism folding a piece of fabric and an improved clamp having a longitudinally and forwardly extending member for grasping the fabric and for moving the fabric along a stitching axis. The clamp also defines a downwardly projecting element on the forward portion thereof and a channel which is disposed on the stitching axis so that the needle of a sewing machine can pass therethrough during the stitching of the fabric.

3 Claims, 3 Drawing Sheets

AUTOMATIC TUCK FORMING APPARATUS HAVING IMPROVED CLAMP MEANS

BACKGROUND OF THE INVENTION

The present invention relates to an automatic tuck forming apparatus having improved clamp means and, more particularly, to an apparatus for folding a piece of cloth over upon itself, and clamping and stitching along a portion of the fold to thereby form a tuck or pleat.

The formation of tuck and/or pleats is a common and necessary operation in the manufacture of clothing. For example, such tucks and/or pleats are used to shorten, decorate and/or control fullness in a garment. However, the formation of such tucks and/or pleats is a time consuming operation, if done by hand, and requires a relatively high degree of skill and accuracy to produce consistent and reproducible results within a reasonable amount of time.

Mechanical apparatus for handling cloth or fabric sheets and for automating a number of stitching operations are known. For example, the U.S. patent to Haddad, U.S. Pat. No. 3,257,978, disclosed a fabric material handling device wherein a downwardly directed airjet nozzle is used to move a sheet of material in a downward direction. In addition, the U.S. Pat. No. 4,491,079 to Gustavsson discloses a device for folding and making a hem on the end edge of a piece of fabric. Gustavsson also discloses means for cutting a thread at the completion of a sewing cycle. And, Pollmeier, U.S. Pat. No. 3,522,783, discloses a sewing machine installation for producing darts and the like (tucks) at a high rate of speed and with good reproducibility.

Notwithstanding the above disclosures, there is a need for an improved apparatus for automatically forming and stitching tucks in a piece of cloth. Therefore, it is an object of this invention to provide an automated apparatus or machine which forms and stitches tucks at a high rate of speed, with high quality and with good reproducibility. It is also an object of the invention to provide an apparatus which is relatively compact, cost competitive, and which can be operated by a relatively unskilled worker. In addition, it is an object of the invention to provide a machine which can handle different types, weights and/or thicknesses of fabric and which can produce tucks and pleats of different widths, all with a high degree of automation. And, finally, it is an object of the invention to provide an improved clamp for use in an automatic tuck forming apparatus.

SUMMARY OF THE INVENTION

In essence, an automatic tuck forming apparatus, according to the present invention, comprises the combination of stitching means, including a reciprocating needle, a fabric support which is preferably disposed on a horizontal plane below the needle at a stitching location and an improved clamp for holding and positioning a folded piece of fabric during the stitching operation. The stitching means may comprise a typical industrial sewing machine and includes means for advancing the fabric linearly past the stitching location and along a stitching axis. A longitudinally extending movable carriage which is approximately coplanar with the fabric support during the stitching operation is disposed on one side of the stitching axis and is adapted to receive a layer of fabric thereon and to move the fabric with respect to the stitching means at the same speed as the fabric is moved by the fabric advancing means. A first clamp or horizontal bar is fixed to the carriage and extends along the longitudinally length of the upper surface thereof and is arranged to clamp the fabric in a predetermined position on the carriage. Means such as an air cylinder and pivot assembly are also provided to rotate a forward edge of the carriage which is closest to the stitching means downwardly to thereby tilt the carriage so that the upper surface thereof is facing the stitching means. Tilting the carriage in the aforesaid manner facilitates the movement of any fabric which extends forwardly from the carriage to drop freely without encountering the fabric support or other parts of the stitching means. Means are also provided for directing a flow of air across the fabric when the carriage is in a tilted position and the first clamp is in a closed position to thereby smooth the fabric or to remove wrinkles therefrom. The apparatus also includes a plate-like folding member which is adjacent to the stitching means and extending outwardly therefrom in the direction of the carriage. Means are also provided for returning the carriage to the horizontal plane and for moving the carriage in a first direction along the x axis with a forwardly extending portion of the carriage and any fabric thereon extending over and above the plate-like folding member to thereby form a fold in the fabric and position the fabric under the needle and along the stitching axis. An improved clamp means includes a mounting member disposed on a second side of the needle and an upper forwardly extending longitudinal portion pivotally mounted thereon and extending beyond the stitching axis and defining an open channel along the stitching axis so that the needle can pass therethrough during the stitching operation. This forwardly extending longitudinally portion also includes a downwardly projecting element or member for grasping or holding the fabric. The improved clamp means also includes a lower portion for engaging a second side of the folded fabric and is constructed and arranged to be raised upwardly into engagement with the underside of the folded fabric which is carried by the forwardly extending portion of the carriage. The pivotal upper portion is then rotated downwardly to press against the folded fabric, and then the first clamp means on the carriage is opened and the carriage moved rearwardly along the x axis away from the improved clamp means. The upper and lower portions of the improved clamp means are then moved downwardly to place the fabric on the sewing plane. With the folded fabric held between the two clamps, means are provided to move the carriage, first clamp means and fabric to sew a portion of the fold to form a tuck therein. Means are further provided for stopping the movement of the carriage and clamps, for deactivating the stitching machine, opening the improved clamp means and moving the carriage rearwardly to remove the tuck from the stitching means. Suitable cutting means may also be provided for cutting the thread at the end of the sewing operation.

DETAILED DESCRIPTION OF THE INVENTION

Figure 1:
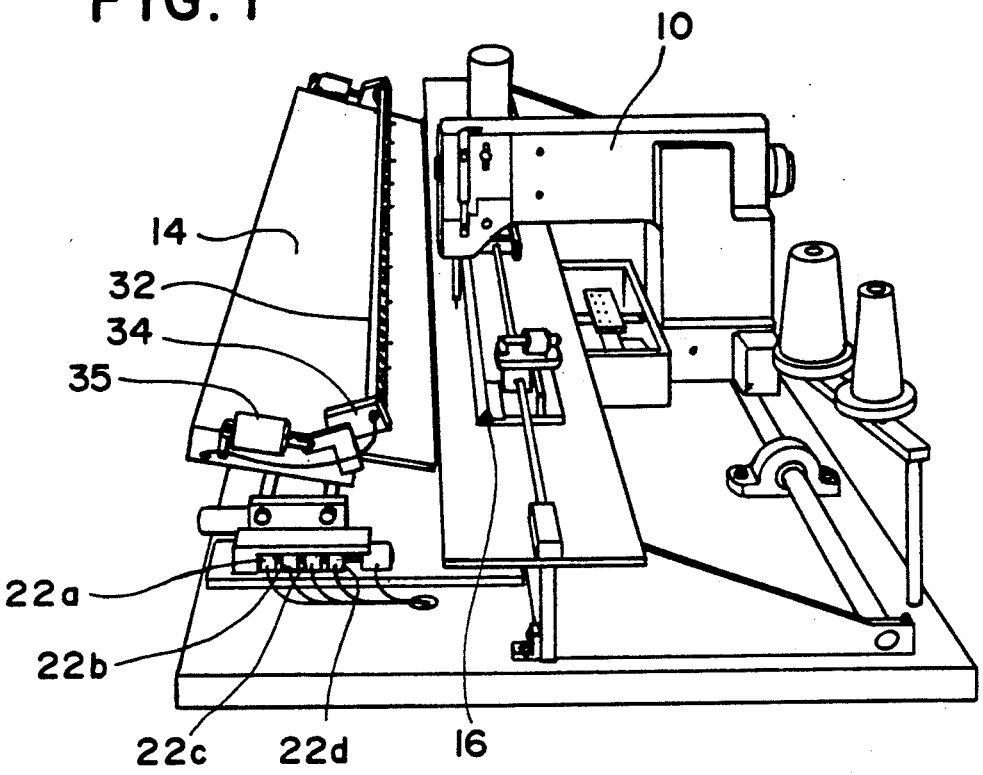
FIG. 1 is a perspective view of an automatic tuck forming apparatus having an improved clamp means according to the invention.

Referring now in more detail to the drawings in which like numerals indicate like parts throughout the several views, FIG. 1 illustrates an automatic tuck forming apparatus according to a preferred embodiment of the invention. As illustrated, the automatic tuck forming apparatus includes the combination of a sewing machine 10 including a reciprocating needle 11, a fabric support 12, a movable carriage 14 and improved clamp 16. The sewing machine 10 may be of any conventional design, but is preferably an industrial type, such as a Mitsubishi model PLK03BTA which has been incorporated in a preferred embodiment of the invention. The sewing machine 10 is mounted at a workstation in a conventional manner. The fabric support 12 is preferably disposed on a horizontal plane below the reciprocating needle 11 and above a bobbin or looper assembly (not shown). The stitching operation is done according to conventional practice which is well understood by those skilled in the art. Accordingly, those operations will not be discussed herein.

The movable carriage 14 is of a generally rectangular configuration and is disposed on a first side of the stitching axis and is constructed and arranged for movement on x—x' and y—y' axis with the x axis perpendicular to and the y axis parallel to the stitching axis. For example, the movable carriage includes a plate-like fabric support 18 and is adapted to move in the y direction along a pair of rods 20, 21 or tracks by means of a conventional drive motor and mechanism not shown.

Figure 2:
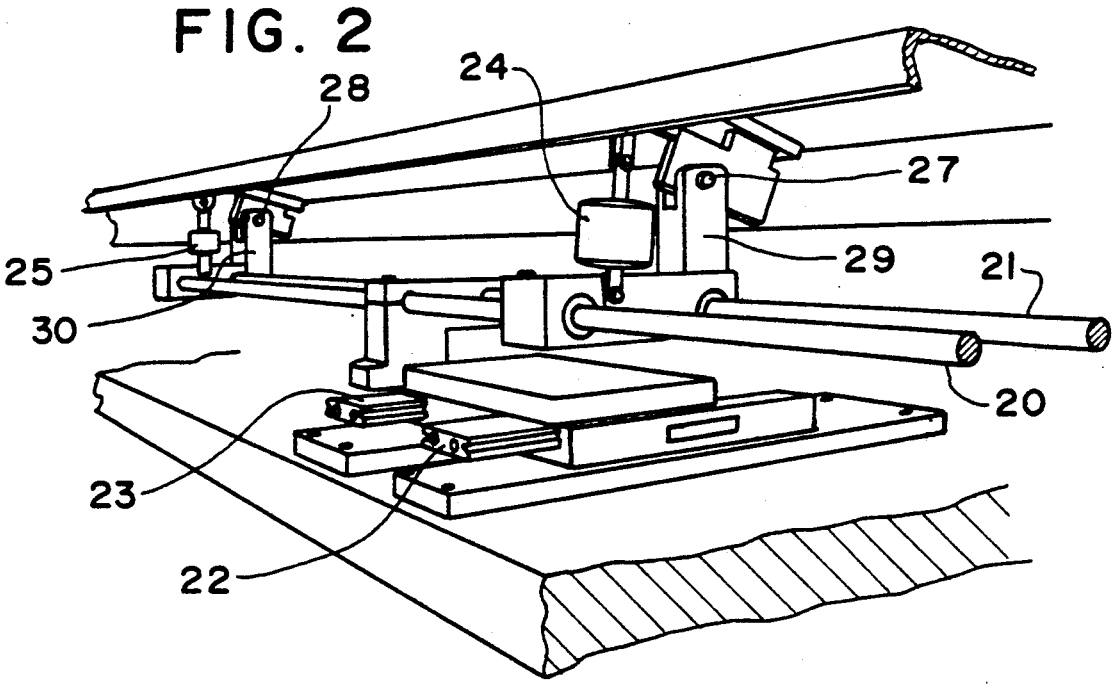
FIG. 2 is a perspective view of a rotatable movable carriage for supporting, positioning and forming a fold in a piece of fabric in an automatic tuck forming apparatus according to the present invention.
Figure 3:
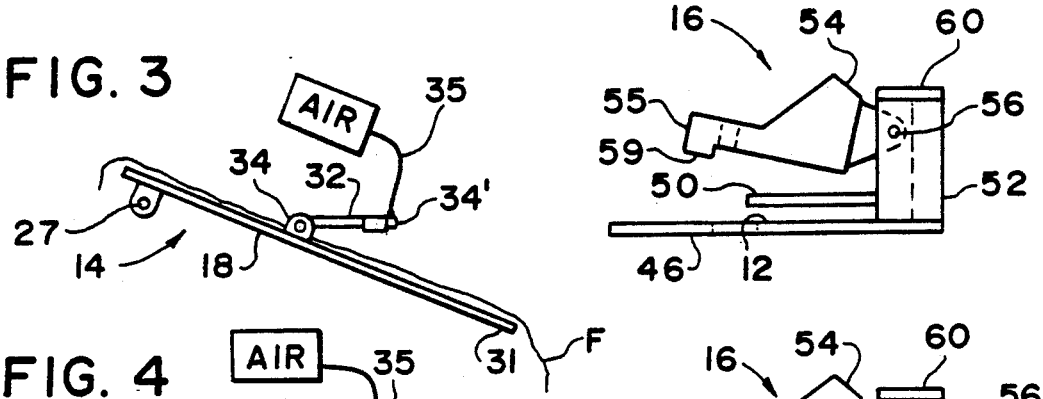
FIG. 3 is a schematic illustration of a movable carriage and improved clamp means according to the present invention wherein the movable carriage is shown in the loading position.
Figure 4:
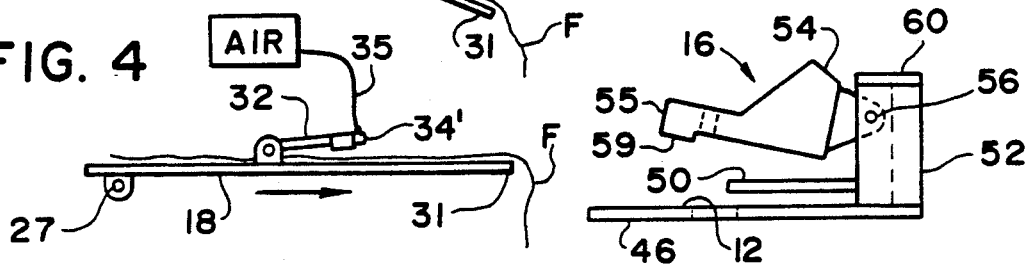
FIG. 4 is a schematic illustration of a movable carriage and improved clamp means according to the present invention wherein the movable carriage is in a horizontal position with a piece of fabric clamped therein and wherein the improved clamp is in an first position.

The carriage 14 is also movable along an x axis toward and away from the sewing machine 12 along a pair of tracks 22 and 23. A single pair of tracks 22 and 23 are illustrated herein; however, in practice a second pair is incorporated at the opposite end of the movable carriage 14. The movement along the x axis is actuated by a plurality of air cylinders 22*a, b, c* and *d* in a manner which will be described hereinafter. The carriage 14 is also movable into a tilted position as illustrated in FIGS. 1, 2 and 3. For example, air cylinders 24 and 25 rotate the fabric support 18 or plate about the pivot points 27 and 28 in brackets 29 and 30 which in effect drops a leading or forward edge 31 downwardly with respect to the sewing or stitching plane.

An elongated bar clamp 32 is pivotally mounted on the carriage 14 by means of a second pair of brackets 34. The bar clamp 32 is pivoted by means of an air cylinder 35 and bell crank 36. In FIG. 1, the bar clamp 32 is shown in its open position.

A plurality of air nozzles 34' are carried by the bar clamp 32 and are constructed and arranged to direct a plurality of air jets or short blasts of air in a downward direction against the fabric F when the bar clamp 32 is in its closed position and the carriage 14 is tilted with respect to the fabric support 12. The nozzles 34 are connected to a source of air pressure (not shown) by means of pneumatic hose 35.

A second clamp 16 (shown more clearly in FIGS. 8 and 9) is disposed on a second side of the stitching axis and is constructed and arranged to grasp a folded piece of fabric and position and moving that fabric on and along the stitching axis for sewing or stitching along the fold. The clamp 16 is mounted for movement along a carrier rod 17 in a direction which is parallel to the stitching axis.

In the operation of the automatic tuck forming apparatus, the sewing machine 10 which includes a vertically reciprocating needle 11 and horizontally disposed fabric support 12 is mounted or fixed at a work location. The movable carriage 14 is adjacent to the sewing machine 10 and is disposed in a first operative position on a horizontal plane so that it is coplanar with the fabric support 12.

At the beginning of a tuck forming cycle, the movable carriage 14 is rotated in a manner so that the edge closest to the sewing machine is moved downward with respect to the fabric support 12 and clamp 32 is moved upwardly into an open position. A piece of fabric F is then placed over the carriage 14 and extends over the edge with a portion thereof hanging down between the carriage 14 and fabric support 12.

The clamp 32 is moved downward against the fabric F to hold the fabric in a first selected position or carriage 14 by means of the air cylinder 35 and bell crank 36 and a jet of air is discharged through air nozzle 34 to assure that the fabric F is relatively free from wrinkles and that the fabric is as far forward on carriage 14 as the clamp 32 permits.

At this stage, the carriage 14 is rotated upwardly to the horizontal plane and forwardly along the x axis toward the sewing machine 10 by means of the air cylinders 22*a, b* and *c*. For example, if the width of the desired tuck is relatively narrow, the carriage 14 will be moved forwardly by means of cylinder 22*a*. However, in those cases wherein wide tucks are desired, the carriage 14 will be advanced further along the x axis by means of cylinders 22*b, c* and *d*.

Figure 5:
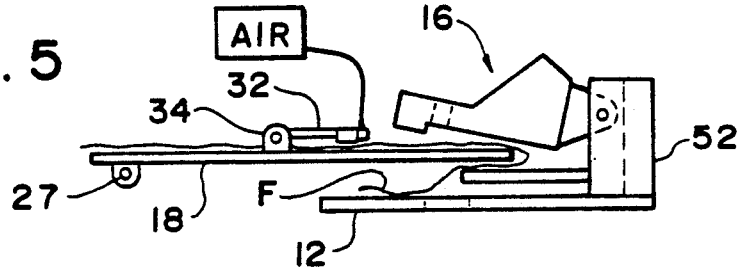
FIG. 5 is a schematic illustration of a movable carriage and improved clamp means according to the present invention wherein the movable carriage and piece of fabric have been moved across the stitching axis and the improved clamp is in an open position.
Figure 6:
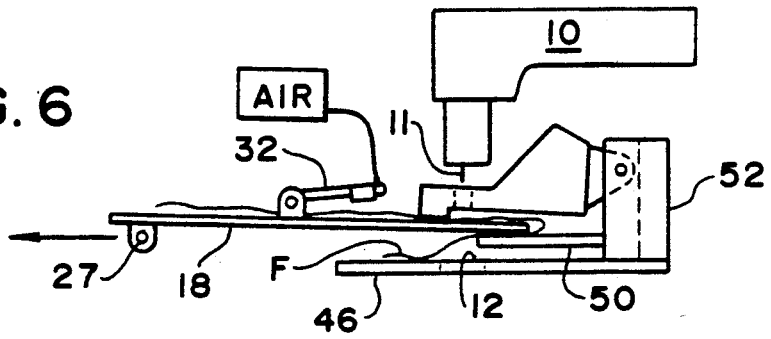
FIG. 6 is a schematic illustration of a movable carriage and improved clamp means according to the present invention wherein the improved clamp is in a partially closed position with a lower portion thereof in an upper position to engage the folded fabric on a forward portion of the carriage.

The movement of carriage 14 moves the fabric over and above a horizontal plate 46 which extends outwardly from below the stitching plane as an extension of the fabric support 12 in the direction of the carriage 14. Thus, the movement of the carriage 14 moves the fabric over the plate 46 to form a fold in the fabric F as shown in FIGS. 5 and 6.

The carriage 14 moves the folded fabric into the open jaws of clamp 16 whereupon an upper portion 54 of clamp 16 is rotated downwardly about pivot 56 and against the fabric F and a forwardly extending plate-like member 50. In a preferred embodiment of the invention, means such as an air cylinder 60 lifts the member 50 upwardly along a vertical axis so that the upper surface of the plate-like member 50 engages the lower fabric layer which extends rearwardly from the fold therein as illustrated in FIG. 6.

Figure 7:
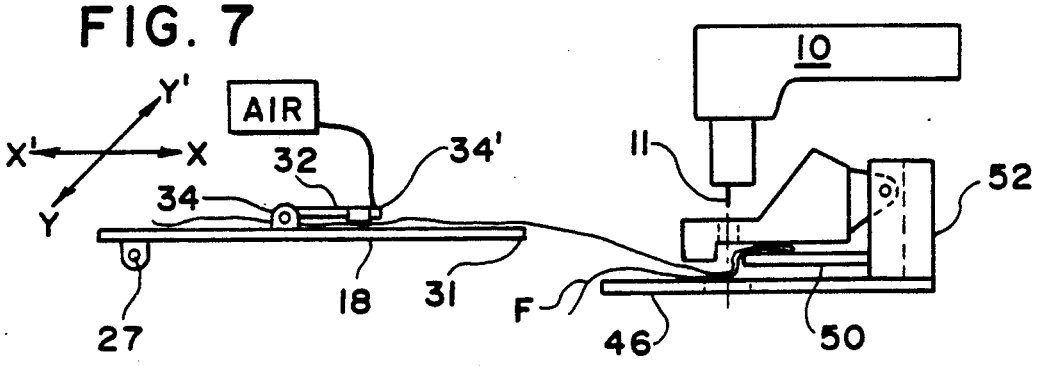
FIG. 7 is a schematic illustration of a movable carriage and improved clamp means according to the present invention wherein the carriage and clamp are in the stitching position.

When the folded fabric is grasped by clamp 16, the bar clamp 32 opens and carriage 14 is moved rearwardly along the x axis away from the sewing machine 12. The clamp 16 is then closed to hold the fabric F under tension for stitching as illustrated in FIG. 7.

The needle 11 is then caused to reciprocate by electrical means and carriage 14, clamp 32 and fabric F are moved along the y and/or stitching axis and the dart or tuck in the fabric is stitched along a desired length thereof.

Figure 8:
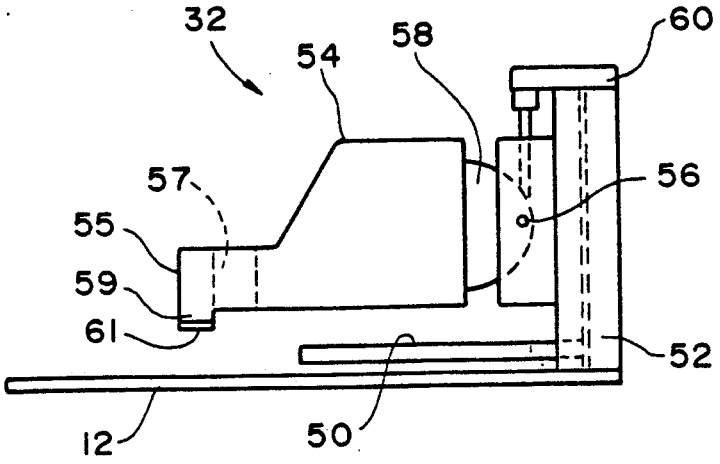
FIG. 8 is a side elevational view of the improved clamp according to the invention.
Figure 9:
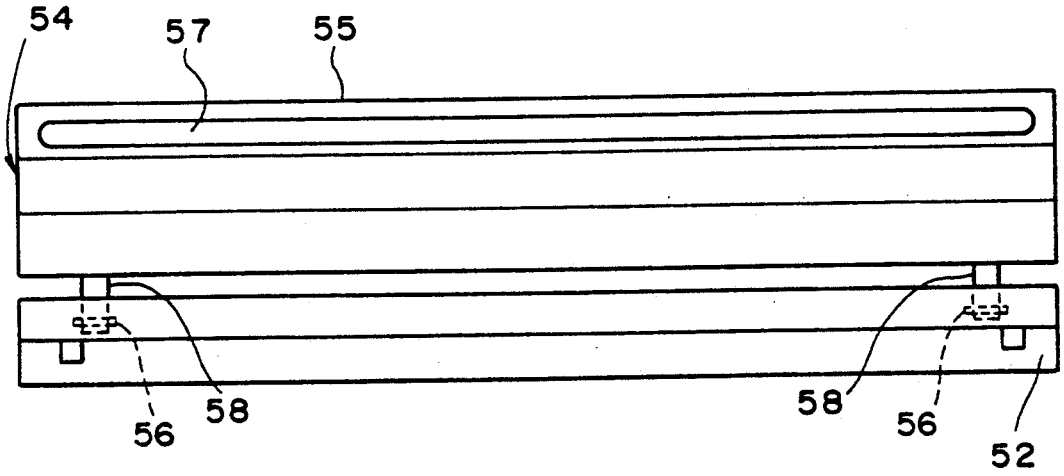
FIG. 9 is a top plan view of the clamp shown in FIG. 8.

As illustrated more clearly in FIGS. 8 and 9, the clamp 16 according to a preferred embodiment of the invention includes a support member 52 and a forwardly extending plate-like member 50 mounted therein in a manner so that member 50 may be raised or lowered with respect to member 52. The clamp 16 also includes a second forwardly and longitudinally extending clamp member 54 carried by mounting member 52 and rotatably mounted with respect to member 52 by means of a pivot 56 and rear projection 58. This pivotal movement opens and closes the clamp in response to activation by an air cylinder 60 or other well known means.

The second forwardly and longitudinally extending clamp member 54 extends forwardly across the stitching axis to define a portion 55 and an open channel 57 which is disposed on the stitching axis so that the needle 11 can pass therethrough during the stitching operation.

The portion 55 also includes a downwardly extending portion or element 59 having a fabric-like tape 61 adhesively bonded thereto for grasping the fabric F and for preventing any slippage of the fabric when it is clamped in place and during the stitching operation. In some cases, it may be desired to eliminate the tape 61 and to provide a rough or scored surface in place thereof. This downwardly extending element 52 should have sufficient height to extend slightly beyond the plate-like member 50 and to press the folded fabric against the fabric support so that the fabric advancing means (not shown) moves the folded fabric along the stitching axis.

After the stitching operation is completed, the clamp 16 is automatically opened and carriage 14 moved further rearwardly along the x axis whereupon it is tilted downwardly so that the process can be repeated for a second tuck or by replacing the fabric.

While the invention has been described in connection with its preferred embodiments, it should be understood that changes and modifications may be made therein without departing from the scope of the appended claims.

What is claimed is:

1. An automatic tuck forming apparatus of the type having:

stitching means for sewing along a stitching axis and including a reciprocating needle which reciprocates along a first axis and a fabric support perpendicular to and intersecting the first axis;

a longitudinally extending movable carriage positionable on a horizontal plane which is approximately coplanar with said fabric support during the operation of said stitching means and disposed on a first side of the stitching axis for receiving a layer of fabric thereon and being movable along an x and y axis within said horizontal plane;

first clamp means having an upper and lower portion disposed on said carriage for holding the fabric in a fixed relationship with said carriage with a portion of the fabric extending over a first side of said carriage which is closest to the stitching axis;

means for rotating said first side of said carriage downwardly along an axis which is parallel with the longitudinal axis of said carriage and coincidental with a second edge of said carriage which is opposite to said first side of said carriage so that the top surface of said carriage faces said stitching means and allows any fabric extending forwardly therefrom in the direction of the stitching means to fall in a downward direction;

means for removing wrinkles from the downwardly extending fabric including a plurality of airjets disposed on said upper portion of said first clamp, for directing a flow of air onto the fabric when the carriage is in an inclined position and the first clamp means is closed to thereby hold the fabric in a fixed position with respect to said carriage;

means for returning said carriage to its horizontal coplanar position;

a horizontal plate adjacent to said fabric support on the side thereof which is next to said carriage, said horizontal plate extending outwardly from said stitching means in the direction of said carriage;

means for moving said carriage in a first direction along the x axis which is perpendicular to the stitching axis over and above the horizontal plate and toward and beyond the stitching axis to thereby form a fold in the fabric with the folded portion under said needle;

second clamp means disposed on a second side of said stitching axis which is opposite from said first side for grasping the folded fabric in a position for stitching;

means for opening said first clamp means to thereby release the fabric held thereby and moving said carriage rearwardly away from said second clamp means along the x axis to thereby advance the fabric with respect to said carriage and means for closing the first clamp means to hold the fabric in its new position on said carriage;

means for moving said carriage, first and second clamp means along the stitching or y axis and for activating said stitching means to thereby sew along a portion of the fold to form a tuck in the fabric;

means for stopping the movement of said carriage and said stitching means; and means for releasing the fabric from said second clamp means for cutting a thread connecting the stitched tuck to the stitching means;

the improvement in said second clamping means comprising a fabric support and a longitudinally extending member having a forwardly extending plate-like member and a rear portion thereof positioning on said second side of the stitching axis wherein the forwardly extending plate-like member engages one side of a folded piece of fabric, a longitudinally extending mounting member, disposed on said rear portion and a second forwardly and longitudinally extending clamp member carried by said mounting member and rotatable with respect to said mounting member so that a lower surface of said second clamp member engages a second side of the folded piece of fabric when said second clamp member is rotated toward said forwardly extended plate-like member, and wherein said second forwardly extending clamp member includes a portion which extends along the other side of the stitching axis and which includes a downwardly extending grasping portion having a textured material adhesively bonded to an underside thereof and wherein said forwardly extending clamp member defines a longitudinally extending open channel along the stitching axis so that the folded fabric is pressed against said fabric support by the downwardly extending portion so that said needle of said stitching means can pass therethrough for stitching the tuck in the fabric.

2. An automatic truck forming apparatus according to claim 1 in which the improvement further comprises means for moving said forwardly extending plate-like member of said second clamp means upwardly into engagement with a bottom fold of the fabric.

3. An automatic truck forming apparatus according to claim 2 in which the improvement further comprises means for moving said forwardly extending plate-like member of said second clamp means upwardly along a vertical axis and into engagement with the bottom fold of the fabric.

* * * * *